US011143210B1

(12) United States Patent
Lee

(10) Patent No.: US 11,143,210 B1
(45) Date of Patent: Oct. 12, 2021

(54) HIGH-LOW HYDRAULIC SYSTEM FOR BALERS, COMPACTORS AND TRANSFER STATION COMPACTORS

(71) Applicant: Anatoly Deninovich Lee, Ponte Vedra, FL (US)

(72) Inventor: Anatoly Deninovich Lee, Ponte Vedra, FL (US)

( * ) Notice: Subject to any disclaimer, the term of this patent is extended or adjusted under 35 U.S.C. 154(b) by 0 days.

(21) Appl. No.: 17/000,957

(22) Filed: Aug. 24, 2020

(51) Int. Cl.

| | |
|---|---|
| ***F15B 11/04*** | (2006.01) |
| ***F15B 11/17*** | (2006.01) |
| ***F15B 11/028*** | (2006.01) |
| ***F15B 9/08*** | (2006.01) |
| ***F15B 13/01*** | (2006.01) |
| ***F15B 13/042*** | (2006.01) |
| ***F15B 11/024*** | (2006.01) |

(52) U.S. Cl.
CPC ..... *F15B 11/04* (2013.01); *F15B 9/08* (2013.01); *F15B 11/024* (2013.01); *F15B 11/028* (2013.01); *F15B 11/17* (2013.01); *F15B 13/015* (2013.01); *F15B 13/0426* (2013.01); *F15B 2211/20538* (2013.01); *F15B 2211/20584* (2013.01); *F15B 2211/30505* (2013.01); *F15B 2211/329* (2013.01)

(58) Field of Classification Search
CPC ..... F15B 11/0406; F15B 11/044; F15B 11/17; F15B 13/015; F15B 2211/20576; F15B 2211/20584; F15B 2211/20592
USPC ..... 60/460; 91/420, 451
See application file for complete search history.

(56) References Cited

U.S. PATENT DOCUMENTS 6,431,049 B1 * 8/2002 Berg ..... E02F 3/3663 137/596.2
8,028,613 B2 * 10/2011 Wrede ..... F15B 11/024 91/420

(Continued)

FOREIGN PATENT DOCUMENTS

CN 109469657 A * 3/2019 ..... F15B 11/17

OTHER PUBLICATIONS

Machine Translation of CN-109469657-A (Year: 2019).*

*Primary Examiner* — Michael Leslie
(74) *Attorney, Agent, or Firm* — Law Office of Mitchell Ghaneie, P.A.; Mitchell Ghaneie; Christopher Roberts

(57) ABSTRACT

The present invention provides an improved high-low hydraulic system for compacting machinery, such as balers, horizontal balers, compactors, transfer station compactors, and the like. The high-low hydraulic system comprises at least one double rotary pump, a plurality of directional control valves, a pilot-operated back pressure reducing valve, a flow control valve, a plurality of one-way valves, and a plurality of pressure switches. The high-low hydraulic system may be regenerative or non-regenerative and provides many advantages over conventional hydraulic systems. Such advantages include greater system efficiency due to a reduced back pressure during the time of the retraction stroke and clever flow sequencing, mitigation of hydraulic shocks at the beginning and end of compaction and retraction strokes, and reduced cycle time of the cylinder during operation due to the concurrent filling of the rod end side during decompression of the blind end side after the compaction stroke. Moreover, the present high-low hydraulic system allows for the cylinder to operate at three or more independent speeds.

8 Claims, 5 Drawing Sheets

(56) References Cited

U.S. PATENT DOCUMENTS

| | | | | |
|---|---|---|---|---|
| 8,635,939 | B2 * | 1/2014 | Linjama | F15B 11/0426 91/6.5 |
| 10,273,987 | B2 * | 4/2019 | Stephan | F15B 13/044 |

* cited by examiner

HIGH-LOW HYDRAULIC SYSTEM FOR BALERS, COMPACTORS AND TRANSFER STATION COMPACTORS

FIELD OF THE INVENTION

This invention relates generally to the field of high-low hydraulic systems used in balers, compactors, transfer station compactors, and the like.

BACKGROUND

Hydraulic systems used within compacting machinery, which compresses material, often comprising of a variety of objects (e.g., trash, cardboard boxes and etc.), into a compacted bundle for easier handling, transport, and storage, are well known. In basic form, such hydraulic systems operate a cylinder, which provides a reciprocating piston. Hydraulic systems used in compacting machinery often utilize a double rotary pump comprising a big displacement pump and a small displacement pump as well as a plurality of directional control valves. Each pump produces a flow that is directionally controlled by the plurality directional control valves within the hydraulic system. Such hydraulic systems are commonly referred to as a high-low hydraulic system.

The cylinder comprises a tubular housing that substantially encloses the piston. The piston is capable, when actuated, of translating within the tubular housing in two directions. The piston extends outward to compress the material and retracts inward to release the material. The piston comprises a blind end side and a rod end side. The extension of the piston is referred to as a compaction stroke and the retraction of the piston is referred to as a retraction stroke. The compaction stroke may be a high-pressure stroke and the retraction stroke is a low-pressure stroke.

Conventionally, at low-pressure, the piston within the cylinder retracts at a high speed because flow from the big and small displacement pumps is concurrently directed to the cylinder. Conversely, at high-pressure, the piston within the cylinder extends at a low speed because only flow from the small displacement pump is directed to the cylinder. When the cylinder is operating under a high-pressure state, the flow from the big displacement pump is directed to a tank by the use of an unloading valve. Before the piston begins to retract, the hydraulic fluid on its blind end side is decompressed by a directional solenoid valve which allows the hydraulic fluid on the blind end side to return to tank. Accordingly, conventional high-low hydraulic systems decompress the hydraulic fluid on the blind end side of the piston such that the retraction stroke of the piston, is delayed until decompression is completed.

Conventional high-low hydraulic systems, at the onset of the compaction stroke, direct the combined flow from the big and small displacement pumps to the cylinder which results in a hydraulic shock that often produces a loud bang. The hydraulic shock, which results from a large pressure spike, can reduce the service life of the compacting machinery. Such rapid accumulation of pressure can be damaging to the cylinder and other components of the hydraulic system. Furthermore, conventional high-low hydraulic systems cannot operate the cylinder at two or more independent speeds, in both directions, at a pressure lower than a pressure setting of an unloading valve that is fluidly coupled to the big displacement pump.

Accordingly, this invention improves the performance of conventional high-low hydraulic systems, whether regenerative or non-regenerative, that are used within compacting machinery, by cleverly controlling flow such that the hydraulic shocks arising at the beginning and end of the compaction and retraction strokes are significantly mitigated. Further, this improved high-low hydraulic system allows the piston to operate at least three independent speeds and increases the system efficiency.

SUMMARY OF THE INVENTION

The present invention provides an improved high-low hydraulic system used for compacting machinery, such as balers, horizontal balers, compactors, transfer station compactors, and the like. Such compacting machinery with hydraulic systems, in general, utilize one or more double rotary pumps in fluid communication with a cylinder to extend and retract the cylinder for the purpose of compacting one or more items.

The high-low hydraulic system, in basic form, comprises a tank, a cylinder, a plurality of one-way valves, a plurality of pressure gauges and pressure switches, at least one flow control valve, at least one strainer, at least one return line filter, a pilot-operated back pressure reducing valve, a plurality of directional control valves, and a double rotary pump which is further comprised of a big displacement pump and a small displacement pump, each with an inlet and outlet.

The cylinder has a first end and a second end. The cylinder comprises a rod, piston, and cylinder housing. The piston has a blind end side, which is substantially adjacent to the first end of the cylinder, and a rod end side, which is substantially adjacent to the second end of the cylinder. The cylinder is actuated (i.e. translated) via fluid pressure generating differential resultant forces acting on opposing sides of the piston.

The plurality of directional control valves comprises at least one solenoid-controlled, pilot-operated directional control valve, hereinafter the "two-stage DCV." Each two-stage DCV has a main section and a pilot section. The main section, being pilot-operated, is fluidly connected to the pilot section by two pilot lines. The two-stage DCV provides a pressure port which is fluidly connected to the main section and the outlet of the big displacement pump. The pilot section has an inlet that is connected to a pilot pressure line which fluidly connects the outlet of the small displacement pump to the pilot section. Each two-stage DCV further comprises six ports. The six ports further comprising the pressure port ("P"), a tank port ("T"), two actuator ports ("A" and "B"), a pilot pressure port ("X"), and a pilot drain port ("Y").

The high-low hydraulic system is configured such as to assist with the mitigation of hydraulic shocks from developing within the cylinder by the cleverly sequencing flow from the big and small displacement pumps to the cylinder during the compaction stroke as well as cleverly diverting flow from the blind end side during decompression via the at least one metered-out flow control valve and, at the end of decompression, by way of the pilot-operated back pressure reducing valve. The clever flow sequencing also allows for a reduced cycle time, which comprises the time required to complete one compaction stroke and one retraction stroke, as a result of the high-low hydraulic system directing flow from the small displacement pump to the rod end side during decompression. Additionally, the clever flow sequencing allows for the cylinder to be operated at three or more independent speeds.

A regular output of the pilot-operated back pressure reducing valve is fluidly connected to the "A" port of the two-stage DCV and the regular input of the pilot-operated back pressure reducing valve is fluidly connected to the tank. The pilot line of the pilot-operated back pressure reducing valve is directly connected to an output of the "B" port of the each two-stage DCV. Additionally, it is anticipated that return lines of the directional control valves, which are fluidly coupled to "T" port of each directional control valve, may be connected to pressure ports of additional directional control valves if the high-low hydraulic system comprises additional auxiliary cylinders.

To reverse the motion of the piston without a significant hydraulic shock, flow from the small displacement pump is first directed to the cylinder to provide a piston speed. Then after a first predetermined time has passed, flow from the outlet of the big displacement pump is directed to the same side of the piston as flow from the outlet of the small displacement pump, thereby producing a combined maximum flow. When an elastic load is present during the compaction stroke, the system pressure required to continue extending the piston will increase as the piston extends. The motor provides a maximum allowable power which governs the maximum allowable pressure that the hydraulic system is capable of producing when operating at a given flow. The pressure switch which is fluidly connected to the outlet of the big displacement pump provides a pressure setting that automatically de-energizes the two-stage DVC when the system pressure is substantially at or above a first maximum allowable pressure. Accordingly, after reaching the first maximum allowable pressure, flow from the outlet of the big displacement pump is unloaded to tank.

Accordingly, the piston is able to continue extending, albeit at a lower speed, due to the flow from the small displacement pump being directed to the blind end side. Finally, after reaching a predetermined pressure, the pressure switch (or transducer) that is fluidly connected to the outlet of the small displacement pump provides a second pressure setting which either initiates decompression of the blind end side or de-energizes the directional control valve that controls the flow from the outlet of the small displacement pump, which results in the fluid isolation of the cylinder and the double rotary pump. Both the blind end side and rod end side of the piston may be isolated from the tank and the double rotary pump if the directional control valves, which each side is respectively fluidly coupled to, are in a neutral, de-energized state. To mitigate a significant hydraulic shock, and a corresponding loud bang, from developing during decompression of the blind end side at the end of the compaction stroke, the metered-out flow control valve is utilized to control the rate at which decompression occurs. The pilot-operated back pressure reducing valve further improves system efficiency as it is automatically opened without requiring additional energy for its operation.

At the onset of decompressing the blind end side, flow from the outlet of the small displacement pump is directed to the rod end side. After a second predetermined time, relative to the start of decompression, flow from the outlet of the big displacement pump is temporarily directed to the rod end side to reduce the time retraction. Flow from the outlet of the big displacement pump is subsequently directed to tank after a third predetermined time to substantially avoid a hydraulic shock at the end of the retraction stroke from developing.

Alternatively, a similar configuration of the improved high-low hydraulic system may be provided without the one or more regenerative blocks. Consequently, output lines from the "A" port of the directional control valves would be directly fluidly connected to each other and to the blind end side of the piston, while the output lines from the "B" ports of the directional control valves would be fluidly connected to each other and to the rod end side of the piston.

NUMBER REFERENCES

Figure 1:
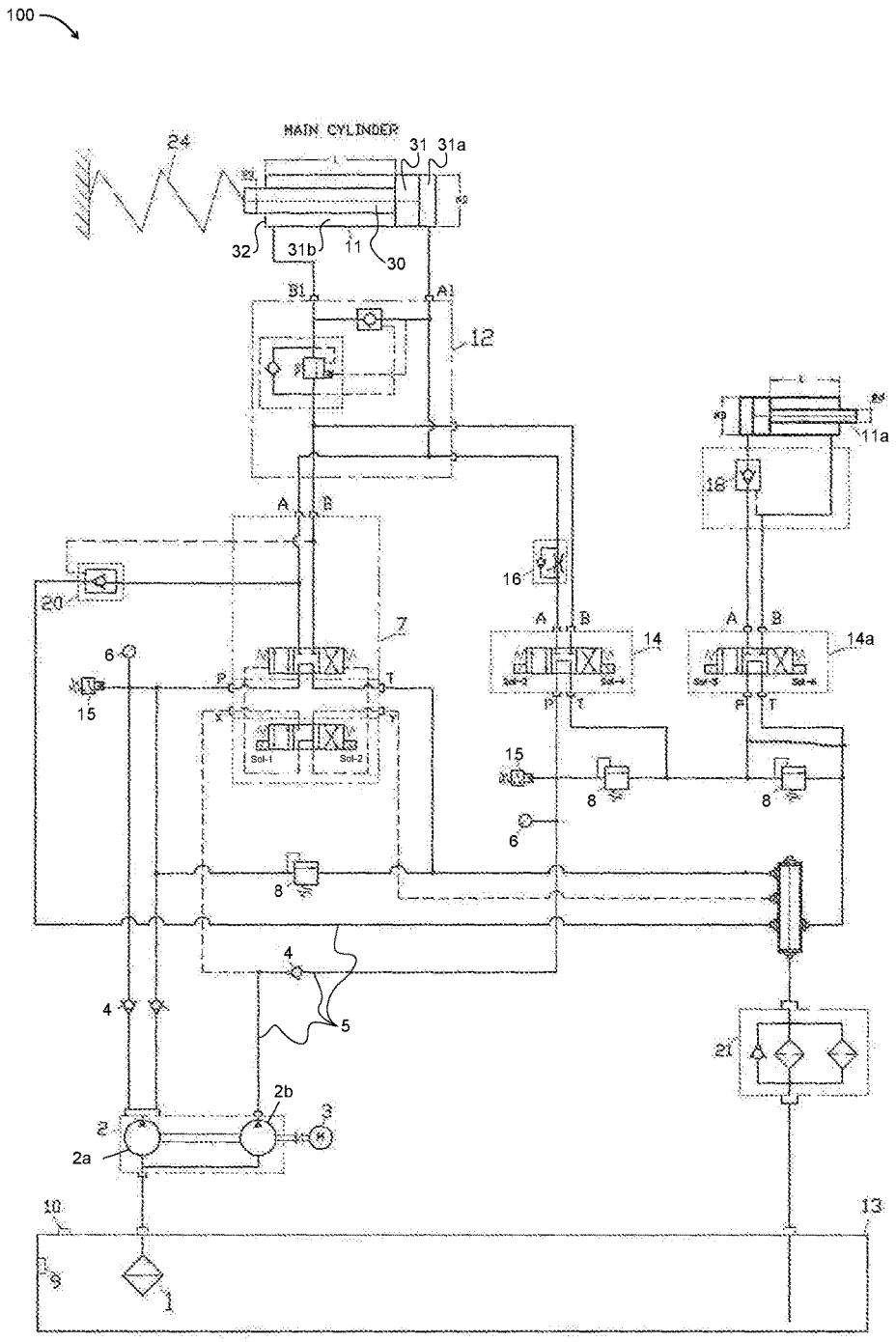
FIG. 1 is a schematic diagram of a first embodiment of a high-low hydraulic system.

1—Strainer
2—Rotary double pump
2*a*—Big displacement pump
2*b*—Small displacement pump
3—Motor
4—One-way valve
5—Plurality of hydraulic fluid conduits
6—Pressure gauge
7—Two-stage DCV
8—Relief valve
9—Oil level gauge
10—Breather
11—Cylinder
11*a*—Auxiliary cylinder
12—Regenerative block
13—Tank
14—One-stage DCV
14*a*—Auxiliary valve
15—Pressure Switch
16—Flow control valve
18—Pilot-operated check valve
20—Pilot-operated back pressure reducing valve
21—Return line filter
23—Independent fan cooler
24—Elastic load
30—Rod
31—Piston
31*a*—Blind end side
31*b*—Rod end side
32—Tubular housing
100—First exemplary embodiment
200—Second exemplary embodiment
300—Third exemplary embodiment
400—Fourth exemplary embodiment
500—Fifth exemplary embodiment
P—Pressure port
T—Tank port
A—First actuator port
B—Second actuator port
X—Pilot pressure port
Y—Pilot drain port
A1—Regen blind end port
B1—Regen rod end port

DETAILED DESCRIPTION

The present invention is an improved high-low hydraulic system, either regenerative or non-regenerative, used in compacting machinery, such as balers, horizontal balers, compactors and transfer station compactors, and the like.

The high-low hydraulic system, hereinafter the "hydraulic system," comprises a double rotary pump 2 which comprises various components including a big displacement pump 2*a* and a small displacement pump 2*b*, each with an inlet and an outlet. The hydraulic system further comprises a motor 3, a plurality of hydraulic fluid conduits 5, a tank 13, a cylinder 11, a plurality of one-way valves 4, a plurality of pressure gauges 6 and pressure switches 15, at least one flow control valve 16, at least one strainer 1, at least one return line filter 21, at least two relief valves 8, an automatic pilot-operated back pressure reducing valve 20, and a plurality of directional control valves. It is also anticipated that the hydraulic system may comprise more than one double rotary pump 2.

The various components of the hydraulic system are fluidly interconnected to one another via the plurality of hydraulic fluid conduit 5 as shown in accordance with the embodiments presented within the figures. It is anticipated, as shown in FIGS. 1, 3, 4, and 5, that the hydraulic system may provide one or more auxiliary cylinders 11*a*, each of which would be fluidly coupled to an additional directional control valve. The cylinder 11 has a first and second end and comprises a rod 30, piston 31, and cylinder housing 32. The rod has two ends, a first rod end and a second rod end. The piston 31 comprises a blind end side 31*a* and a rod end side 31*b*. The blind end side 31*a* is substantially adjacent to the first end of the cylinder 11. The first rod end of the rod 30 is integrally attached to the rod end side 31*b* of the piston 31. The cylinder 11 is actuated, i.e. translated, via fluid pressure resulting in differential, opposing resultant forces acting on opposing sides 31*a*, 31*b* of the piston 31.

The tubular housing 32 provides a hermetically sealed interior chamber. The interior chamber is divided into two compartments, which are separated by the piston 31 and vary in volume depending on the position of the piston 31 within the interior chamber. The tubular housing 32 further provides a pair of ports which allow the two compartments, and thereby the blind end side 31*a* and rod end side 31*b*, to be fluidly coupled to the double rotary pump 2, tank 13, or each other.

The plurality of directional control valves comprises at least one solenoid-controlled, pilot-operated directional control valve 7, hereinafter a "two-stage DCV 7." Each two-stage DCV 7 has a main section and a pilot section. The main section, being pilot-operated, is fluidly connected to the pilot section by two pilot lines. The main section is fluidly connected to the outlet of the big displacement pump 2*a*. The pilot section is fluidly connected to the outlet of the small displacement pump 2*b*.

Each two-stage DCV 7 provides a pressure port P ("P" port), which is fluidly connected to the outlet of the big displacement pump 2*a*, a pilot pressure port X ("X" port), which is fluidly connected to the outlet of the small displacement pump 2*b*, a first actuator port A ("A" port), a second actuator port B ("B" port), a tank port T ("T" port), and a pilot drain port Y ("Y" port). The two-stage DCV 7 has a tandem center position, which results in flow from the outlet of the big displacement pump 2*a* being directed to tank 13 when the two-stage DCV 7 is in a neutral state. The pilot section, hereinafter referred to as the "pilot valve", is a solenoid-controlled, four way 3-position valve with a float center position. The pilot valve provides two solenoids, a first solenoid Sol-1 and a second solenoid Sol-2. When the first solenoid Sol-1 is activated, the pilot valve is actuated such that flow entering the "P" port of the two-stage DCV 7, is directed to "A" port while concurrently directing flow from "B" port to "T" port. Conversely, when the second solenoid Sol-2 is activated, flow entering the "P" port of the two-stage DCV 7 is directed to "B" port while concurrently directing flow from "A" port to "T" port.

The inlet of the double rotary pump 2 is fluidly coupled to the tank 13 via an inlet line. The inlet line, which is further provided by the hydraulic system, fluidly connects the tank 13 to the double rotary pump 2 as well as to the at least one strainer 1. Each outlet of the double rotary pump 2 is fluidly coupled to at least one of the plurality of one-way valves 4. The one-way valve 4 that has an inlet fluidly coupled to the outlet of the small displacement pump 2*b* has a cracking pressure that is larger than the minimum system pressure required to operate each two-stage DCV 7. The outlet of the small displacement pump 2*b* is fluidly connected to each pilot valve of each two-stage DCV 7, via a pilot line that connects to the pilot pressure port X of each two-stage DCV 7.

Referring to FIG. 1, a first exemplary embodiment 100 of the hydraulic system is presented. The plurality of directional valves further comprises a solenoid-controlled, four way 3-position valve 14 with an inlet fluidly coupled to the outlet of the small displacement pump 2*b*. The solenoid-controlled, four way 3-position directional control valve 14, hereinafter the "one-stage DCV 14", has a tandem center position and provides a third solenoid Sol-3 and a fourth solenoid Sol-4. The one-stage DCV 14 also has four ports. The four ports of the one-stage DCV 14 comprise a pressure port P ("P" port), which is fluidly coupled to the outlet of the small displacement pump 2*b*, a first actuator port ("A" port), a second actuator port B ("B" port), and a tank port T ("T" port), which is fluidly coupled to the tank 13. The flow control valve 16, which has an inlet and outlet, is metered-out such that its outlet is fluidly coupled to the "A" port of the one-stage DCV 14. The flow control valve 16 also provides a one-way bypass. The one-way bypass comprises a one-way check valve that has an inlet fluidly coupled to the "A" port of the one-stage DCV 14.

Prior to activation of any of the solenoids provided by the plurality of directional control pumps, the double rotary pump 2 produces a minimum pump pressure as flow from both the big and small displacement pumps 2*a*, 2*b* is directed to tank 13. After energizing the third solenoid Sol-3, the one-stage DCV 14 directs flow from the small displacement pump 2*b* to the blind end side 31*a* to begin a compaction stroke. The piston 31 and rod 32, being affixed to one another, begin moving with a low speed. Subsequently, after a first predetermined time, the first solenoid Sol-1 is energized, thereby resulting in a maximum combined flow (i.e., flow from both pumps 2*a*, 2*b*) being directed to the blind end side 31*a*. Such a flow sequence allows for the piston to gradually increase speed during the compaction stroke, which substantially avoids a hydraulic shock from being produced.

The regenerative block 12 comprises a counterbalance valve which, upon reaching a predetermined pressure setting, gradually fluidly decouples the rod end side 31*b* from the blind end side 31*a*, thereby terminating the regenerative mode. Upon reaching a first predetermined pressure on the blind end side 31*a*, the pressure switch 15 fluidly coupled to the outlet of the big displacement pump 2*a* automatically de-energizes the first solenoid Sol-1 which allows the two-stage DCV 7 to return to its the neutral center position, thereby unloading flow from the outlet of the big displacement pump 2*a* to the tank 13. It is anticipated that a pressure transducer could alternatively be used in place of the pressure switch 15 to perform the same function.

The flow from the outlet of the small displacement pump 2*b* remains fluidly connected to the blind end side 31*a* until a second predetermined pressure is reached. Upon system pressure reaching the second predetermined pressure, the pressure switch 15 fluidly coupled to the outlet of the small displacement pump automatically de-energizes the third solenoid Sol-3. As a result, the flow from the small displacement pump 2*b* is unloaded to the tank 13 and accumulation of additional pressure on the blind end side 31*a* substantially ceases.

Decompression of the blind end side 31*a* is provided by energizing of the fourth solenoid Sol-4. The decompression time is adjusted by the metered-out flow control valve 16. During decompression, the hydraulic system cleverly allows flow from the outlet of the small displacement pump 2*b* to begin filling the rod end side 31*b*. At the end of decompression, the resultant force acting on the piston 31 due to the fluid pressure on the rod end side 31*b* begins to exceed the resultant force acting on the piston 31 due to the fluid pressure on the blind end side 31*a*, and as a result the rod 30 and piston 31 begin to retract. After a second predetermined time, the second solenoid Sol-2 is energized, thereby allowing flow from the big displacement pump 2*a* to be fluidly coupled with the rod end side 31*b*. The combined maximum flow increases the speed of the retraction of the rod 30 and piston 31, thereby reducing the time it takes to substantially translate the piston 31 and restart the compaction stroke.

Allowing flow from the big displacement pump 2*a* and small displacement pump 2*b* to be concurrently directed to the rod end side 31*b* avoids any substantial delay of starting a retraction stroke after initiating decompression. To avoid a hydraulic shock from being produced at the end of the retraction stroke, the second solenoid Sol-2 is de-energized after a third predetermined time when the piston 31 reaches a predetermined distance from the first end of the cylinder 11. De-energizing the second solenoid Sol-2 causes the two-stage DCV 7 to return to its neutral position, which results in the flow from the outlet of the big displacement pump 2*a* to be unloaded to the tank 13.

After the second solenoid Sol-2 is de-energized, the piston 31 continues to retract towards the first end of the cylinder 11 at a reduced speed due to only flow from the small displacement pump 2*b* being directed to the rod end side 31*b*. Additionally, during the retraction stroke, a back pressure reducing pilot operated check valve 20, hereinafter the "back pressure reducer 20," is opened by a pilot pressure line directly connected to a hydraulic conduit that is directly connected to the second actuator port "B" of the two-stage valve 7. The back pressure reducer 20 increases system efficiency by automatically reducing the pressure needed on the rod end side 31*b* to complete the retraction stroke.

Additionally, within the first exemplary embodiment 100, the one-stage DCV 14 is series connected to an additional solenoid-controlled, four way 3-position valve 14*a*, hereinafter the "auxiliary valve 14*a*." The auxiliary valve 14*a* provides a fifth solenoid Sol-5 and a sixth solenoid Sol-6. The "T" port of the one-stage DCV 14 is connected to a "P" port of the first auxiliary valve 14*a* to operate an auxiliary cylinder 11*a*. The blind end side of the auxiliary cylinder 11*a* is fluidly connected to a pilot operated check valve 18.

Figure 2:
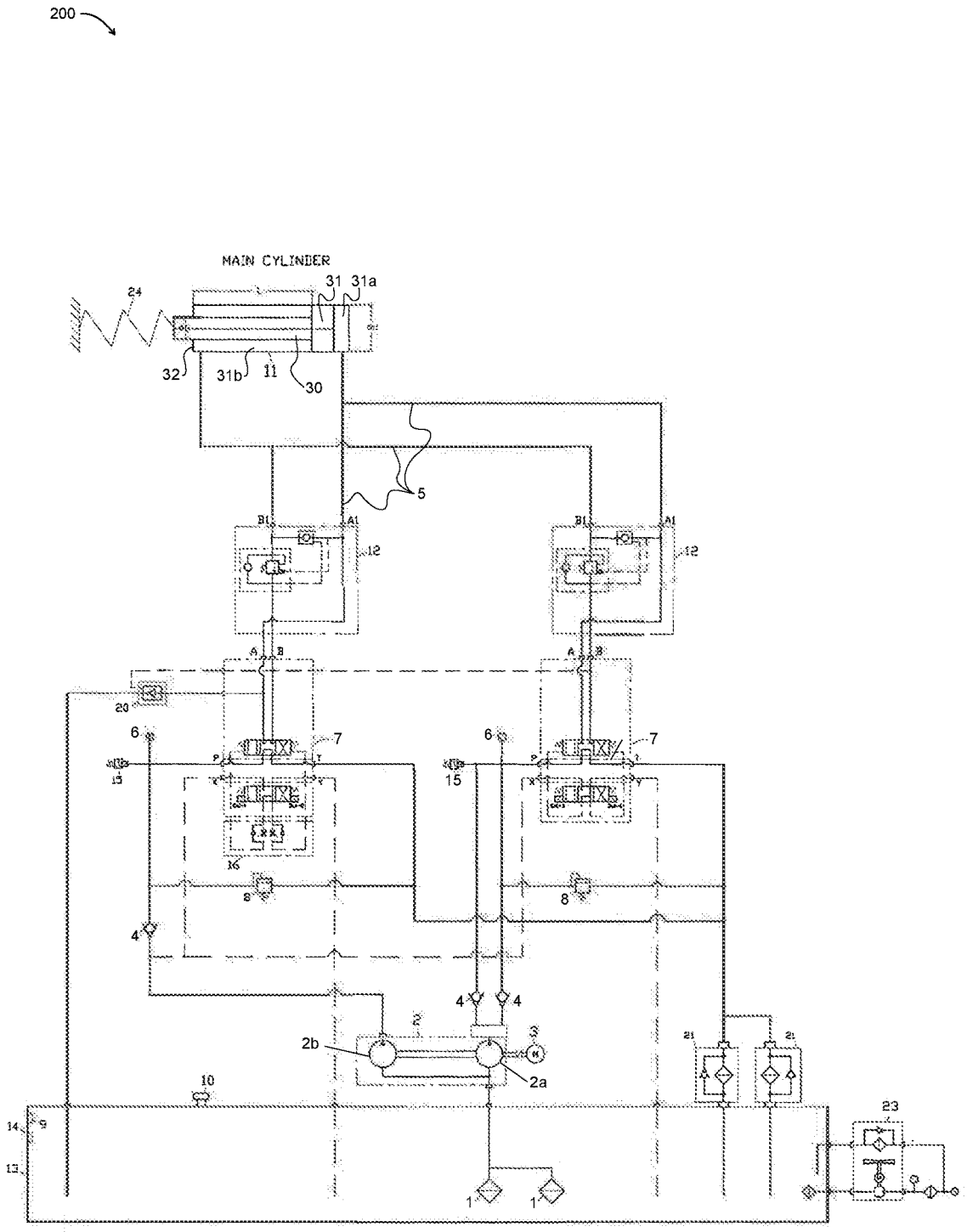
FIG. 2 is a schematic diagram of a second embodiment of the high-low hydraulic system.

With reference to FIG. 2, a second exemplary embodiment 200 of the hydraulic system comprises a second two-stage DCV 7. Each of the two-stage DCV 7 provide a distinct regenerative block 12. Additionally, a pilot line of the back pressure reducer 20 is connected to a direct output of the "B" port of both two-stage DCVs 7. An output from each of the first actuator ports "A" of each two-stage DCV 7 are directly fluidly coupled to each other, to an output from the regen blind end port "A1" of each regenerative block 12, and to the blind end side 31*a* of the cylinder 11. The output from each of the second actuator ports "B" of each two-stage DCV 7 are directly fluidly coupled to each other to produce a pilot pressure for the back pressure reducer 20 and to the inlet of each regenerative block 12. Each regen rod end port "B1" of each regenerative block 12 is fluidly coupled to one another and to the rod end side 31*b* of the cylinder 11.

The hydraulic system of the second exemplary embodiment 200 begins operating without a load as flow is directed by both two-stage DCVs 7 to tank 13. After energizing of the first solenoid Sol-1 of the two-stage DCV 7 that is fluidly coupled to the small displacement pump 2*b*, the compaction stroke is initiated, albeit at a low speed due. Subsequently, shortly after the passing of the first predetermined time, the third solenoid Sol-3 of the two-stage DCV 7 that is fluidly coupled to the big displacement pump 2*a* is energized and, as a result, flow is directed from the big displacement pump 2*a* to the blind end side 31*a*. The cylinder 11 is thereby operating at a maximum speed due to the combined maximum flow from both pumps 2*a*, 2*b* as well as flow from the rod end side 31*b* via a regeneration mode provided by both regenerative blocks 12.

At a predetermined pressure the pressure switch 15 fluidly coupled to the outlet of the big displacement pump 2*a* de-energizes the third solenoid Sol-3 and as result, the flow from the big displacement pump 2*a* is unloaded to tank 13. Similarly, the regenerative mode provided by each regenerative block 12 is ended at a pressure setting of a counterbalance valve provided by each regenerative block 12. Finally, the compaction stroke is stopped once a predetermined pressure is reached on the blind end side 31*a*. Upon reaching the predetermined pressure that stops the compaction stroke, the pressure switch 15 fluidly connected to the outlet of the small displacement pump 2*b* automatically sends a signal that de-energizes the first solenoid Sol-1. As a result, the two-stage DCV 7 that is fluidly connected to the small displacement pump 2*b* returns to a neutral state and flow from the small displacement pump 2*b* is unloaded the tank 13. Accordingly, pressure ceases to substantially increase on the blind end side 31*a*. Decompression on the blind end side 31*a* is provided by energizing the second solenoid Sol-2. The decompression time is adjusted by a metered-out flow control valve 16 that is fluidly coupled to the two-stage DCV 7 that is fluidly connected to the small displacement pump 2*b*.

During decompression of the hydraulic fluid on the blind end side 31*a*, the rod 30 and piston 31 begin retracting upon the activation of the second solenoid Sol-2 which subsequently fluidly connects the blind end side 31*a* to the tank 13 and allows flow from the small displacement pump 2*b* to start filling the compartment on the rod end side 31*b*, which in turn allows for a reduced cycle time. After the second predetermined time is developed on the rod end side 31*b* the fourth solenoid Sol-4 is energized and subsequently allows flow from the big displacement pump to be directed to the rod end side 31*b*, thereby allowing the rod 30 and piston 31 to retract at a maximum speed. During the retraction stroke, the back pressure reducer 20 is opened by the pilot pressure in the pilot line that connects to the direct joint outputs from the second actuator port "B" of both two-stage DCVs 7. The back pressure reducer 20 increases system efficiency by reducing the pump pressure needed on the rod end side 31*b* to complete the retraction stroke.

Figure 3:
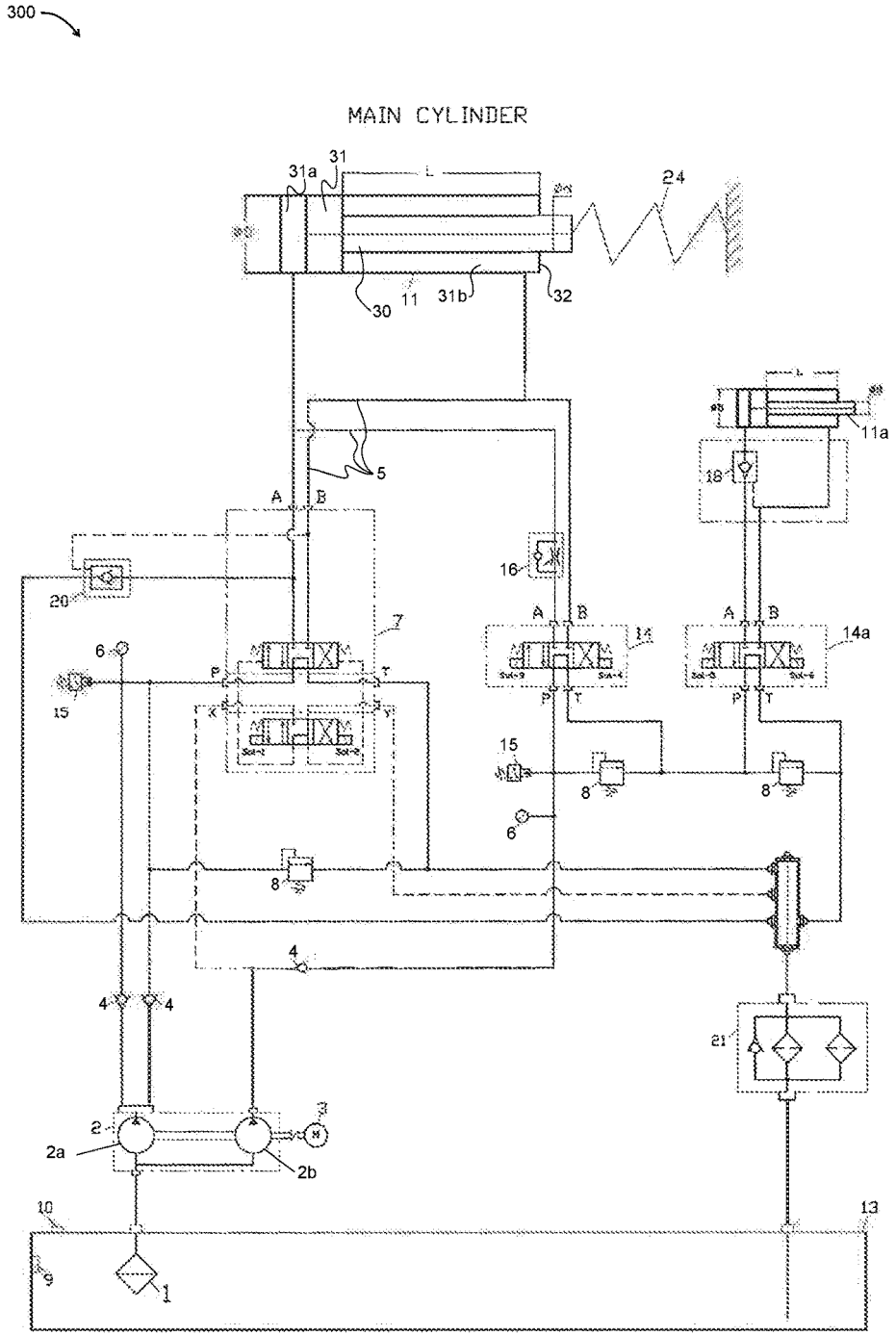
FIG. 3 is a schematic diagram of a third embodiment of the high-low hydraulic system.

With reference to FIG. 3, a third exemplary embodiment 300 of the hydraulic system is shown which comprises a non-regenerative configuration of the first exemplary embodiment 100 of the hydraulic system presented FIG. 1.

Figure 4:
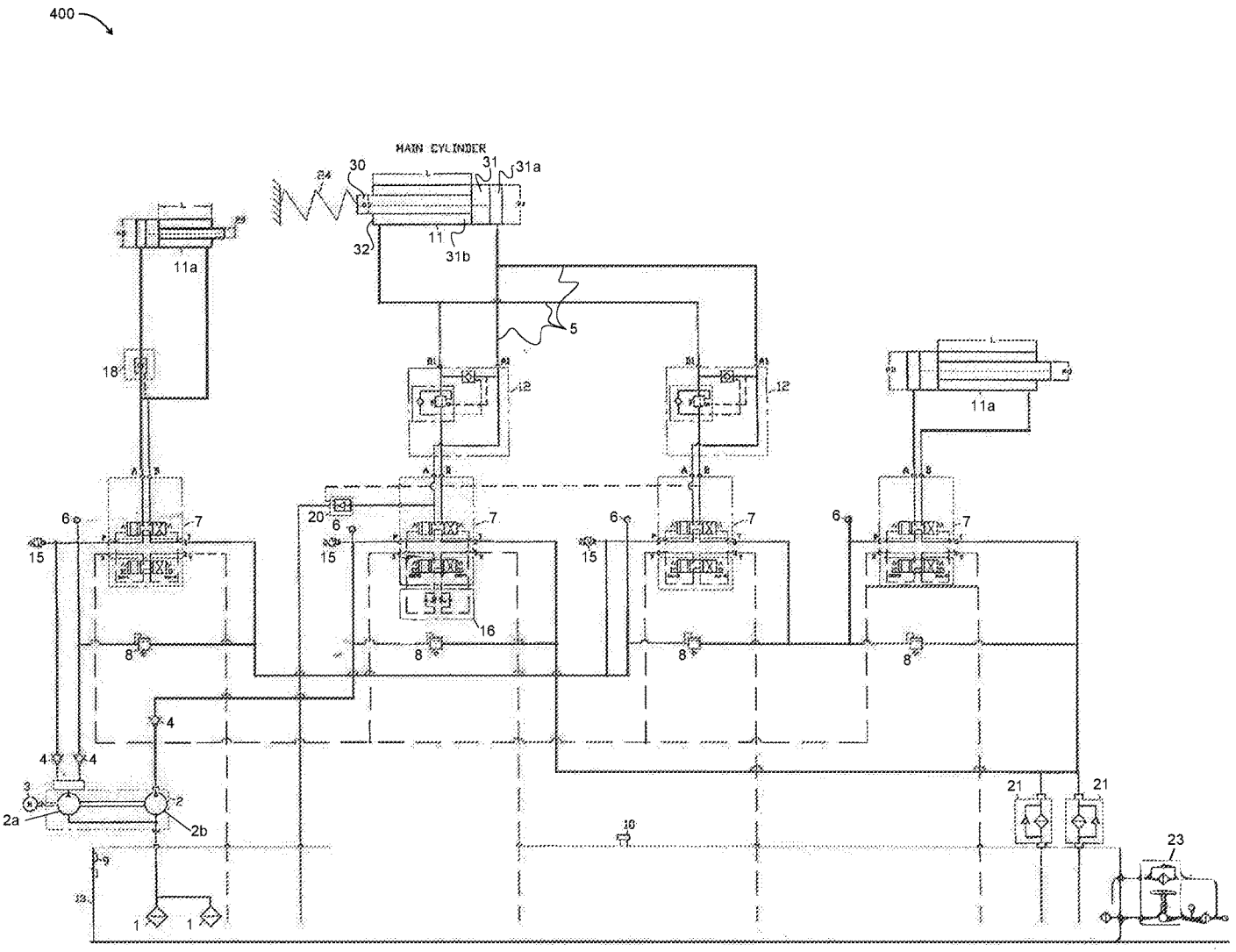
FIG. 4 is a schematic diagram of a fourth embodiment of the high-low hydraulic system.

With reference to FIG. 4, a fourth exemplary embodiment 400 of the hydraulic system comprises a regenerative system with additional series connected two-stage DCVs 7 which are fluidly coupled to additional auxiliary cylinders 11*a*.

Figure 5:
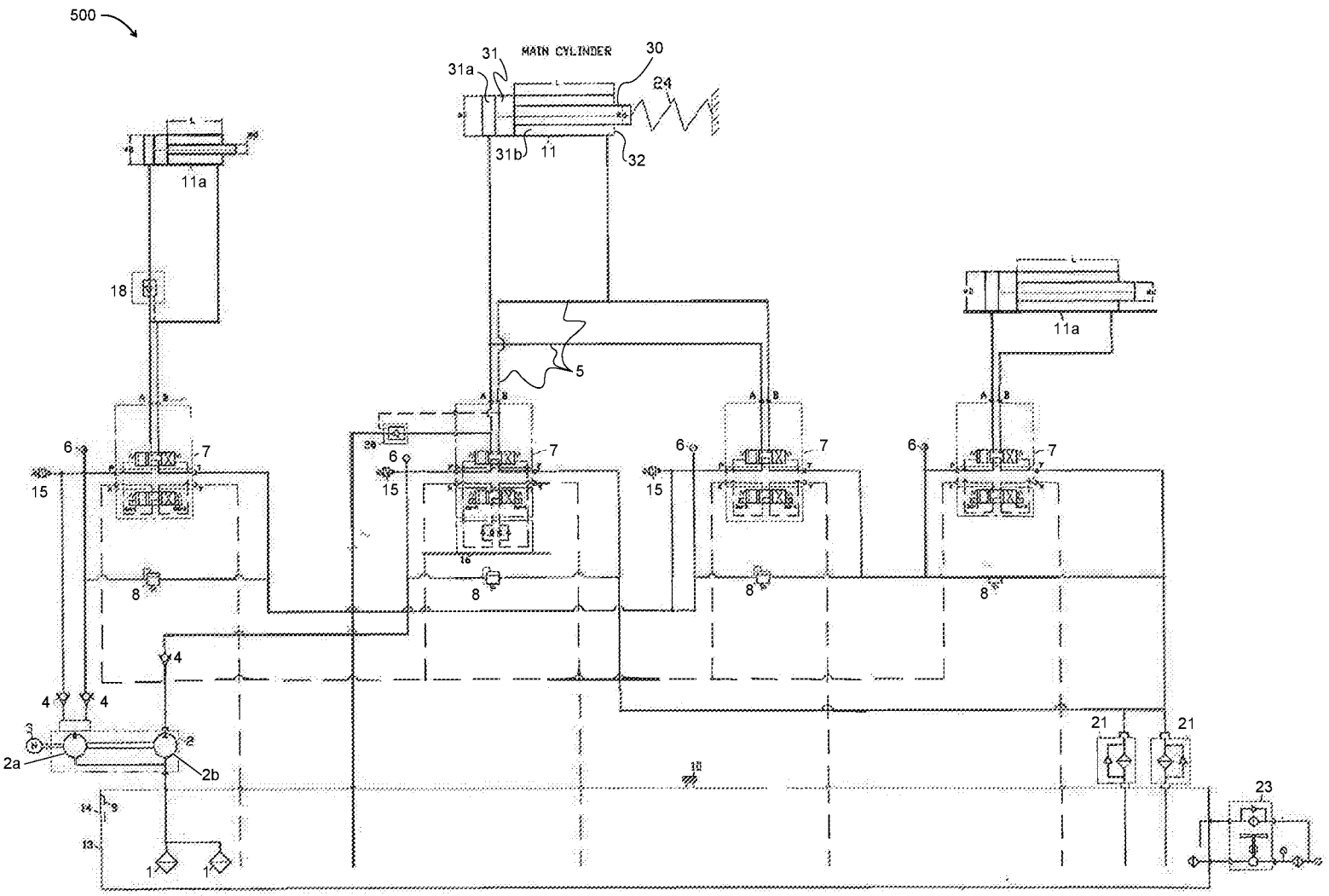
FIG. 5 is a schematic diagram of a fifth embodiment of the high-low hydraulic system.

With reference to the drawing FIG. 5, a fifth exemplary embodiment 500 of the hydraulic system which comprises a non-regenerative configuration of the fourth exemplary embodiment 400 of the hydraulic system presented FIG. 4.

While the embodiments of the invention have been disclosed, certain modifications may be made by those skilled in the art to modify the invention without departing from the spirit of the invention.

The inventor claims:

1. A high-low hydraulic system comprising:

a. at least one double rotary pump;

wherein each double rotary pump comprises a big displacement pump and a small displacement pump;

wherein the big displacement pump and small displacement pump each have an inlet and at least one outlet;

b. a motor;

c. a plurality of hydraulic fluid conduits;

d. a tank;

e. a cylinder;

wherein the cylinder comprises a tubular housing, a rod, and a piston;

wherein the tubular housing provides a hermetically sealed interior chamber;

wherein the piston comprises a blind end side and a rod end side;

f. one or more regenerative blocks;

g. a plurality of one-way valves;

h. a plurality of directional control valves;

wherein the plurality of directional control valves comprises at least one two-stage valve;

wherein each two-stage valve provides a pressure port, a tank port, two actuator ports, a pilot pressure port, and a pilot drain port;

wherein the two actuator ports comprise a first actuator port (A) and a second actuator port (B);

i. a plurality of pressure switches;

j. at least one flow control valve;

k. a pilot-operated back pressure reducing valve;

wherein the pilot-operated back pressure reducing valve has an inlet and an outlet;

wherein the pilot-operated back pressure reducing valve has a pilot line;

wherein the pilot line is directly connected to an output of the second actuator port (B) of each two-stage valve;

wherein the outlet of the pilot-operated back pressure reducing valve is fluidly coupled to the blind end side;

wherein the inlet of the pilot-operated back pressure reducing valve is fluidly coupled to the tank.

2. The high-low hydraulic system of claim 1, further comprising the piston and rod extending and retracting at three or more independent speeds.

3. The high-low hydraulic system of claim 2, wherein the three or more independent speeds comprise a maximum speed produced by the combined flow of the big displacement pump and small displacement pump.

4. The high-low hydraulic system of claim 2, wherein a flow provided by the small displacement pump is fluidly coupled to the rod end side during decompression of the blind end side.

5. A high-low hydraulic system comprising:

a. at least one double rotary pump;

wherein each double rotary pump comprises a big displacement pump and a small displacement pump;

wherein the big displacement pump and small displacement pump each have an inlet and at least one outlet;

b. a motor;

c. a plurality of hydraulic fluid conduits;

d. a tank;

e. a cylinder;

wherein the cylinder comprises a tubular housing, a rod, and a piston;

wherein the tubular housing provides a hermetically sealed interior chamber;

wherein the piston comprises a blind end side and a rod end side;

f. a plurality of one-way valves;

g. a plurality of directional control valves;

wherein the plurality of directional control valves comprises at least one two-stage valve;

wherein each two-stage valve provides a pressure port, a tank port, and two actuator ports;

wherein the two actuator ports comprise a first output (A) and a second output (B);

h. a plurality of pressure switches;

i. at least one flow control valve;

j. a pilot-operated back pressure reducing valve;

wherein the pilot-operated back pressure reducing valve has an inlet and an outlet;

wherein the pilot-operated back pressure reducing valve has a pilot line;

wherein the pilot line is fluidly coupled to the rod end side;

wherein the outlet of the pilot-operated back pressure reducing valve is fluidly coupled to the blind end side;

wherein the inlet of the pilot-operated back pressure reducing valve is fluidly coupled to the tank.

6. The high-low hydraulic system of claim 5, further comprising the piston and rod extending and retracting at three or more independent speeds.

7. The high-low hydraulic system of claim 6, wherein the three or more independent speeds comprise a maximum speed produced by the combined flow of the big displacement pump and small displacement pump.

8. The high-low hydraulic system of claim 7, wherein a flow provided by the small displacement pump is fluidly coupled to the rod end side during decompression of the blind end side.

* * * * *